US005660234A

United States Patent [19]

Hebert et al.

[11] Patent Number: 5,660,234

[45] Date of Patent: Aug. 26, 1997

[54] SHALLOW FLOW WELLHEAD SYSTEM

[75] Inventors: Paul A. Hebert; Lionel J. Milberger, both of Houston; Joseph W. Pallini, Jr., Tomball, all of Tex.

[73] Assignees: ABB Vetco Gray Inc., Houston, Tex.; Chevron Corporation, San Francisco, Calif.

[21] Appl. No.: 593,157

[22] Filed: Feb. 1, 1996

[51] Int. Cl.[6] ..... E21B 7/12; E21B 33/14; E21B 43/01; E21B 47/06

[52] U.S. Cl. ..... 166/368; 166/285; 166/332.1; 166/337

[58] Field of Search ..... 166/250.08, 285, 166/332.1, 337, 367, 368, 373, 382, 386

[56] References Cited

U.S. PATENT DOCUMENTS

| | | | |
|---|---|---|---|
| 4,220,207 | 9/1980 | Allen | 166/367 |
| 4,249,611 | 2/1981 | Zijlstra | 166/367 |
| 4,444,401 | 4/1984 | Roche et al. | 166/363 X |
| 4,560,005 | 12/1985 | Helderle et al. | 166/373 X |
| 4,832,126 | 5/1989 | Roche | 166/358 |
| 5,029,647 | 7/1991 | Milberger et al. | 166/368 X |
| 5,184,686 | 2/1993 | Gonzalez | 166/367 X |
| 5,188,180 | 2/1993 | Jennings | 166/338 |
| 5,188,181 | 2/1993 | Brammer et al. | 166/368 X |
| 5,226,478 | 7/1993 | Henderson, Jr. et al. | 166/285 |
| 5,439,061 | 8/1995 | Brammer et al. | 166/368 |

*Primary Examiner*—George A. Suchfield
*Attorney, Agent, or Firm*—James E. Bradley

[57] ABSTRACT

A subsea wellhead system is used in areas which have shallow water producing sands. A first string of casing extends from the sea floor through a section of conductor pipe and below the conductor pipe to a point above the water sand. An external wellhead housing having flow ports is supported at the upper end of the conductor pipe. A valve sleeve is located on the exterior of the external wellhead housing. The valve sleeve is movable to a closed position, closing the flow ports. A second string of casing is installed to a point below the water producing formation. An internal wellhead housing is secured to the upper end of the second string of casing, which lands within the external wellhead housing. During cementing of the second string of casing the flow ports are open. After cementing, the valve sleeve is moved to the closed position.

6 Claims, 3 Drawing Sheets

SHALLOW FLOW WELLHEAD SYSTEM

BACKGROUND OF THE INVENTION

1. Field of the Invention

This invention relates in general to offshore drilling, and in particular to a subsea wellhead system for use in areas which have shallow, unconsolidated water producing formations.

2. Description of the Prior Art

A common offshore technique involves drilling a first section of the hole and installing conductor pipe with an external wellhead housing at the upper end. The external wellhead housing will be located approximately at the sea floor. Then, the operator drills the well to a second depth and installs a first section of casing. An internal or high pressure wellhead housing is usually located at the upper end of the first string of casing. This first string of casing will be cemented in the well, with cement returns flowing up around the casing, through the conductor pipe and out flow ports located in the external wellhead housing. These flow ports remain open after cementing.

The operator retrieves the running tool for the internal wellhead housing and connects a drilling riser and blowout preventer to the internal wellhead housing. The operator will then drill the well to greater depths and normally install at least two more strings of casing. Each string of casing has a casing hanger at its upper end which will land and seal in the internal wellhead housing.

In some areas, the conventional technique described above is not satisfactory. For example, one area in the Gulf of Mexico has an unconsolidated sand formation approximately 1000 below sea level. This formation has a pressure that is higher than the pressure at the sea floor by approximately 50–250 psi. When drilled into, the formation tends to wash out, with water and sand flowing upward to the sea floor. If the well washes out severely, this can be a dangerous problem.

Various techniques have been employed to overcome the washout problem. A cement is available that is of a foaming type which can be employed to retard washout. U.S. Pat. No. 5,184,686 discloses a system for avoiding washout. However, that system requires using two different size drilling risers at various stages of the drilling. This makes the technique very expensive.

In another prior art system, each of the flow ports in the external wellhead housing is connected to a ball valve which can be closed by a remote operated vehicle after the internal wellhead housing is installed. Closing the ball valves assures that if leakage from the water producing formation begins after completion of the well, it will not flow out the flow ports, causing a dangerous washout. However, it is advantageous to have several flow ports to allow a high flow rate while the flow ports are open. Several ball valves add substantially to the expense of a completed well and to operating difficulties.

SUMMARY OF THE INVENTION

In this invention, the external wellhead housing has a number of flow ports. A valve sleeve mounts to the exterior of the wellhead housing. The sleeve is axially movable between an open position and a closed position, blocking flow through the ports.

In this method, first the well will be formed to a first depth and conductor pipe installed with the external wellhead housing located at the upper end and spaced a short distance above the sea floor. The first depth is substantially less than the depth of the shallow water producing formation. The valve sleeve is in the open position at this point.

Then, in the preferred method, the well is drilled to a second depth which is still above the water producing formation. A first string of casing will be cemented in this section of the well and supported by a scab hanger. The scab hanger does not land in the external wellhead housing but lands and seals in a landing sub located a short distance below the external wellhead housing. This first or outer string of casing will extend to a short distance, for example 300 feet, above the water sand.

The operator then drills a pilot hole of relatively small diameter through the water producing formation to a third depth a short distance below the water producing formation. After drilling, the operator swabs the hole with a foaming-type cement to build up a mudcake and retard washout. The operator then reams out the well to a diameter for receiving a second string of casing.

The operator then runs the second string of casing with a high pressure or internal wellhead housing located at the upper end. The operator runs the second string of casing with a running tool which latches to the external wellhead housing. The operator cements the second string of casing with returns flowing out the open flow ports in the internal wellhead housing.

Once cementing is completed, the operator uses the running tool to move the valve sleeve to the closed position, closing the flow ports. The operator retrieves the running tool and installs a drilling riser and blowout preventer to the internal wellhead housing. The well will then be drilled to greater depths with at least two strings of casing installed.

A monitoring valve will be mounted to a monitoring port in a section of the conductor pipe between the landing sub and the external wellhead housing. The monitoring valve can be periodically opened and closed by a remote operated vehicle after the well has been completed to make sure that no pressure build up has occurred in the annulus surrounding the second string of casing. A pressure build up would indicate that the water producing formation had started to flow. Also, the remote operated vehicle can visually inspect the external sleeve periodically to make sure that no leakage is occurring through the flow ports. If a malfunction occurs, the external sleeve can be removed by pulling it upward over the external wellhead housing and replaced.

DETAILED DESCRIPTION OF THE INVENTION

Figure 1:
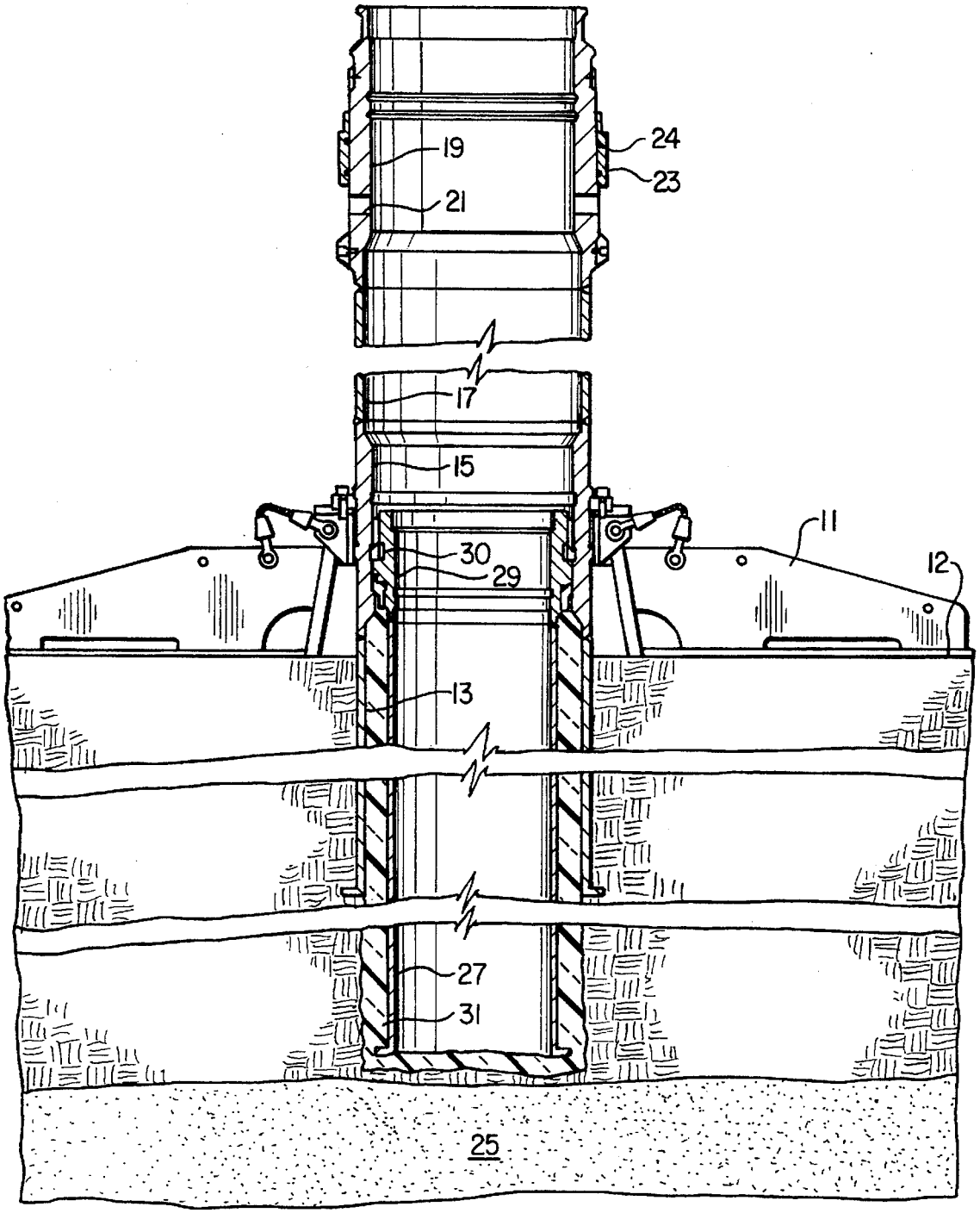
FIG. 1 is a sectional view illustrating a subsea wellhead system shown prior to installation of a high pressure external wellhead housing.

Referring to FIG. 1, mud mat 11 is a type of a base that locates on the sea floor 12. The well will be jetted to a first depth, normally a few hundred feet, and conductor pipe 13 installed. Conductor pipe 13, normally 36 inches in diameter, will be installed in a conventional manner. Mud mat 11 will be carried to the sea floor 12 as conductor pipe 13 is installed. Conductor pipe 13 is supported on mud mat 11 by a landing sub 15. Landing sub 15 is a tubular member which latches into mud mat 11 and is connected into conductor pipe 13.

Figure 3:
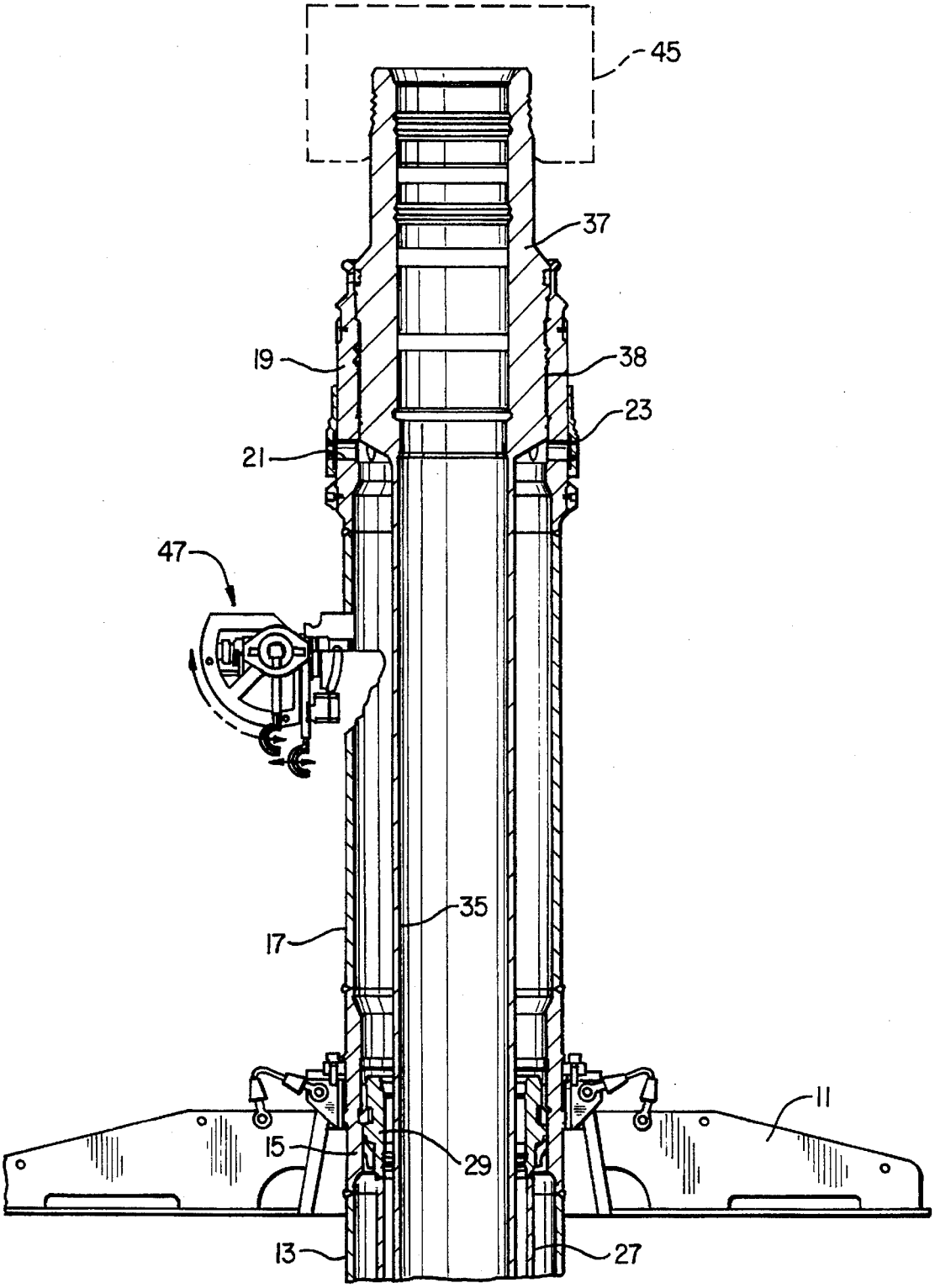
FIG. 3 is another sectional view of the subsea wellhead system of FIG. 1, showing a drilling riser installed on the high pressure wellhead housing.

Conductor pipe 13 has an extension 17 that extends above landing sub 15 a few feet to support an external or low pressure wellhead housing 19. External wellhead housing 19 is a large tubular member having a plurality of flow ports 21 spaced around its circumference. An external valve sleeve 23 mounts slidably to the exterior of external wellhead housing 19. Valve sleeve 23 has seals 24 and will move between an open position shown in FIG. 1 to a closed position shown in FIG. 3. When moved downward to the closed position, valve sleeve 23 will block any flow through flow ports 21. Valve sleeve 23 will be in the open position initially.

After the installation of external wellhead housing 19, the drilling rig at the surface of the sea will drill the well to a second depth. This second depth will stop a short distance above water producing formation 25, for example, 200 feet. Water producing formation 25 is a loose, unconsolidated sand formation that produces water and has a formation pressure that is 50–250 psi greater than the pressure at the sea floor 12. Without precautions, water and sand from formation 25 will flow up the well to sea floor 12 and wash out the well to a very large diameter. Consequently, the operator will terminate drilling the second phase of the well at a point above formation 25.

The operator then installs a first string of casing 27. Casing 27 is preferably about 26 inches in diameter and is supported by a scab hanger 29 at its upper end. The operator cements casing 27 in place, as indicated by the numeral 31. The cementing operation is conventional. While pumping cement, the operator will position scab hanger 29 a short distance above its landing profile to allow cement returns to flow up and out flow ports 21. The operator will land and seal scab hanger 29 in an internal profile in landing sub 15 below external wellhead housing 19. A split ring 30 on scab hanger 29 latches into a groove in landing sub 15 to retain scab hanger 29 to landing sub 15. Split ring 30 is released to snap into the groove by the running tool (not shown) for the scab hanger 29. An annulus seal is installed between scab hanger 29 and landing sub 15. After the cement has set, the well will appear as shown in FIG. 1.

The operator then drills a pilot hole (not shown) through formation 25, terminating a short distance below formation 25. The pilot hole may be 12¼ inches in diameter, and known drilling fluid additives are employed to retard washout in formation 25. After drilling, the operator swabs the pilot hole with a foaming type cement. The foaming cement permeates the loose sand, creating a hardened mud cake annulus in the well to retard washout. The operator then reams out this third section of the well to approximately 23 inches in diameter.

Figure 2:
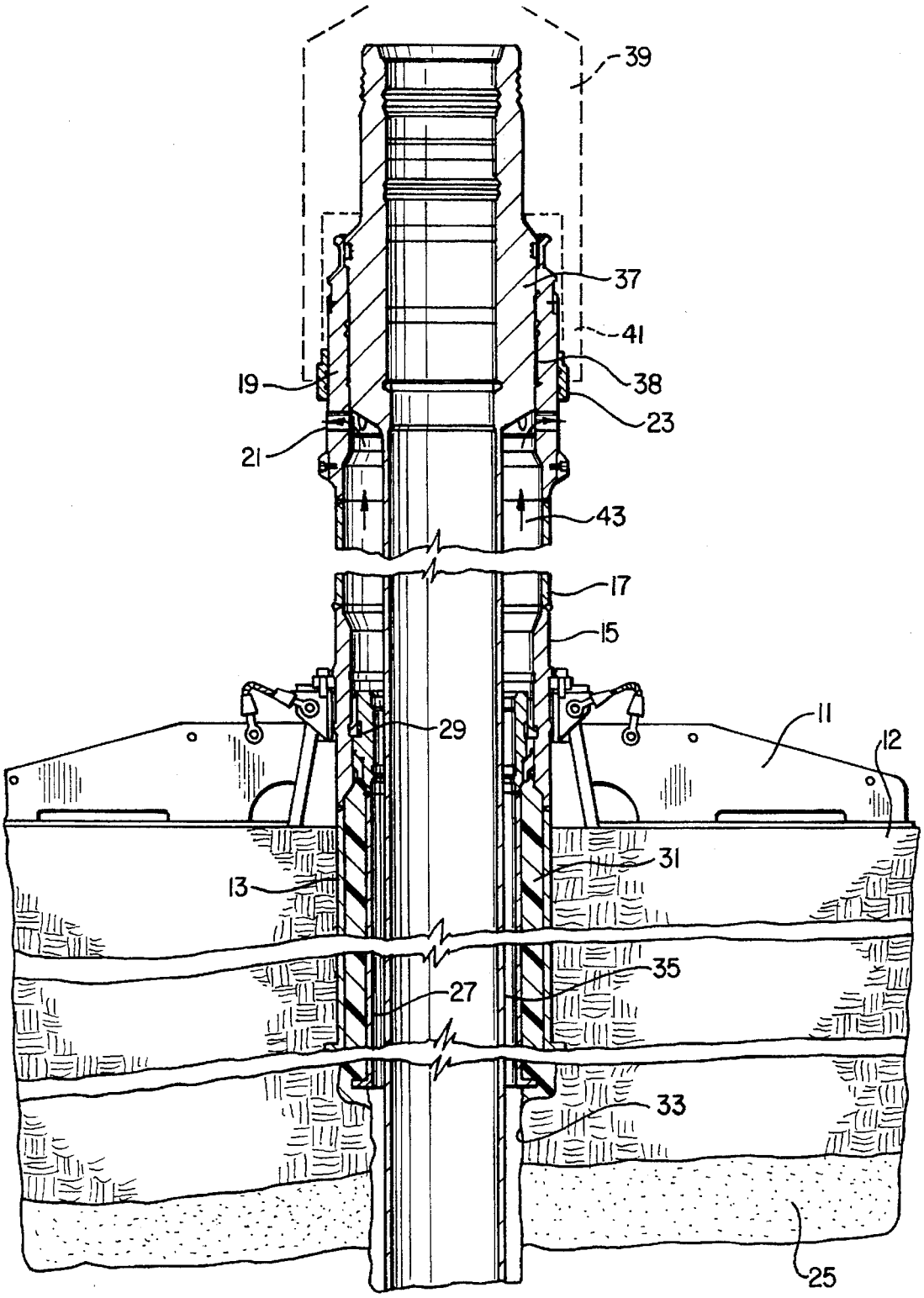
FIG. 2 is a sectional view of the wellhead system of FIG. 1, showing the external wellhead housing being landed.

Referring to FIG. 2, the third hole section is indicated by the numeral 33. It is large enough to accept a second string of casing 35 which is preferably 20 inches in diameter. Second string 35 has an internal or high pressure wellhead housing 37 at its upper end. Internal wellhead housing 37 is of a conventional type and inserts within external wellhead housing 19 generally as shown in U.S. Pat. No. 5,029,647, Jul. 19, 1991. It has external tapered sections 38 that wedge tightly within tapered sections in the bore of external wellhead housing 19. A running tool 39, such as shown in U.S. Pat. No. 5,188,180, Feb. 23, 1993, is employed to apply a large axial force to install internal wellhead housing 37. Once installed, the lower end of tapered section 38 of wellhead housing 37 will be spaced a short distance above flow ports 21, which will still be open. The upper end of internal wellhead housing 37 will protrude above the upper end of external wellhead housing 19.

After landing and installation, the operator pumps cement down, which returns up the annulus in well section 33, as indicated by arrows 43. The cement returns flow out the flow ports 21. Once casing 35 is cemented in place, the operator moves valve sleeve 23 from the upper open position to a closed position closing flow ports 21. This is preferably handled by running tool 39, which utilizes a skirt 41 for engaging valve sleeve 23 and moving it downward after cementing.

After valve sleeve 23 has closed flow ports 21, the operator retrieves running tool 39 and connects a drilling riser 45 which includes a blowout preventer. The operator then drills the well to greater depths, installing third and fourth strings of casing (not shown) within the second string of casing 35. These strings of casing will be supported and sealed by casing hangers which land conventionally within internal wellhead housing 37.

A monitoring valve 47 is secured to a monitoring port in conductor extension 17 below external wellhead housing 19. Monitoring valve 47 communicates with the annulus surrounding the second casing string 35 within conductor pipe 13. Monitoring valve 47 may be of a ball type that is conventional and can be actuated by a remote operated vehicle ("ROV"). Periodically, after the well is completed, the ROV will open valve 47 to determine if any pressure exists within conductor extension 17. If so, this would indicate that the cement surrounding second casing string 35 was leaking, allowing flow from formation 25 up the annulus surrounding second casing string 35. The closed valve sleeve 23 prevents the flow of formation fluid out the flow ports 21.

The ROV can also monitor whether valve sleeve 23 is leaking by visual inspection through video. The internal diameter of valve sleeve 23 is greater than the outer diameter of external wellhead housing 19 above valve sleeve 23. The internal diameter of valve sleeve 23 is also greater than the outer diameter of internal wellhead housing 37. Consequently, if leakage is detected, valve sleeve 23 can be removed by a retrieval tool (not shown) which inserts over internal and external wellhead housings 37, 19. The retrieval tool will pull valve sleeve 23 up off of the external wellhead housing 27 and remove it to the surface. The retrieval tool could install valve sleeve 23 after repairing or install a replacement valve sleeve 23. There is no need to remove internal wellhead housing 37.

The invention has significant advantages. Only a single drilling riser is required, not two as in certain prior art techniques. This greatly reduces the expense of drilling a well. The flow ports allow a large amount of flow, which is necessary during cementing with foaming type cement. The valve sleeve closes the flow ports to prevent subsequent flow that might occur after the well has been completed. The external valve sleeve does not require a separate trip to be closed, rather it is closed by the running tool for the high pressure wellhead housing. Also, the external valve sleeve can be retrieved for repair or replacement after the well has been completed without removing the internal wellhead housing.

While the invention has been shown in only one of its forms, it should be apparent to those skilled in the art that it is not so limited but is susceptible to various changes without departing from the scope of the invention. For example, the external wellhead housing could be run without the valve sleeve installed. After running the first casing string and scab hanger, the initial drilling vessel could be moved to a new location. Later another drilling vessel could be placed on location for drilling through the water producing sand, landing the internal wellhead housing and completing the well. The valve sleeve could be installed on the external wellhead housing when running the internal wellhead housing.

We claim:

1. A subsea well assembly, comprising:

a subsea external wellhead housing connected to a string of conductor pipe, the external wellhead housing having a sidewall containing a plurality of flow ports;

an internal wellhead housing secured to a string of casing which extends through the conductor pipe;

landing profile means for supporting the internal wellhead housing in the external wellhead housing in a position so as to not block the flow ports; and a valve sleeve mounted to an exterior portion of the sidewall of the external wellhead housing and movable axially relative to the internal and external wellhead housings between an open position, exposing the flow ports, and a closed position, closing the flow ports.

2. The subsea well assembly according to claim 1, further comprising:

a monitoring port in the conductor pipe below the flow ports for monitoring the pressure in the annulus.

3. The subsea well assembly according to claim 1, wherein no portions of the external wellhead housing and the internal wellhead housing above the valve sleeve have outer diameters any greater than an inner diameter of the valve sleeve, allowing the valve sleeve to be subsequently retrieved in the event of malfunction by pulling the valve sleeve upward over the external wellhead housing and the internal wellhead housing.

4. A subsea well assembly, comprising:

a subsea external wellhead housing connected to a string of conductor pipe and located at the sea floor, the external wellhead housing having a sidewall, a bore with an internal landing profile and a plurality of flow ports extending through the sidewall and located below the internal landing profile;

an internal wellhead housing secured to a string of casing which extends through the conductor pipe, the internal wellhead housing having an external landing profile supported in the internal landing profile of the external wellhead housing above the flow ports; and a valve sleeve mounted to an exterior portion of the sidewall and movable axially relative to the external wellhead housing between an open position, exposing the flow ports, and a closed position, closing the flow ports; and a monitoring port in the conductor pipe above the sea floor and below the flow ports to allow monitoring of pressure in an annulus in the conductor pipe surrounding the casing.

5. The subsea well assembly according to claim 4, wherein the valve sleeve has an inner diameter which is greater than any portion of the external wellhead housing and the internal wellhead housing above the valve sleeve, allowing the valve sleeve to be subsequently retrieved in the event of malfunction by pulling the valve sleeve upward over the external wellhead housing and the internal wellhead housing.

6. A subsea well assembly comprising:

a subsea external wellhead housing connected to a string of conductor pipe and located at the sea floor, the external wellhead housing having a sidewall, a bore with an internal landing profile and a plurality of flow ports extending through the sidewall and located below the internal landing profile;

an internal wellhead housing secured to a string of casing which extends through the conductor pipe, the internal wellhead housing having an external landing profile supported in the internal landing profile of the external wellhead housing above the flow ports;

a valve sleeve mounted to an exterior portion of the sidewall and movable axially relative to the external wellhead housing between an open position, exposing the flow ports, and a closed position, closing the flow ports; and wherein the valve sleeve has an inner diameter which is greater than any portion of the external wellhead housing and the internal wellhead housing above the valve sleeve, allowing the valve sleeve to be subsequently retrieved in the event of malfunction by pulling the valve sleeve upward over the external wellhead housing and the internal wellhead housing.

* * * * *